US005103973A

United States Patent [19]

Sato

[11] Patent Number: 5,103,973

[45] Date of Patent: Apr. 14, 1992

[54] LID FOR CAN-SHAPED CONTAINER

[75] Inventor: Wasuke Sato, Tokyo, Japan

[73] Assignee: Showa Denko K.K., Tokyo, Japan

[21] Appl. No.: 614,946

[22] Filed: Nov. 19, 1990

Related U.S. Application Data

[63] Continuation of Ser. No. 358,754, May 30, 1989, abandoned.

[30] Foreign Application Priority Data

May 30, 1988 [JP] Japan ..... 1-130160

[51] Int. Cl.[5] ..... B65D 17/34

[52] U.S. Cl. ..... 220/270; 220/268; 220/258; 220/359

[58] Field of Search ..... 220/214, 257, 258, 270, 220/268, 269, 359

[56] References Cited

U.S. PATENT DOCUMENTS

| | | | |
|---|---|---|---|
| 3,765,561 | 10/1973 | Hekal et al. . | |
| 3,981,412 | 9/1976 | Asmus | 220/258 |
| 4,044,941 | 8/1977 | Knudsen | 220/258 |
| 4,210,618 | 7/1980 | Piltz et al. | 220/258 |
| 4,212,409 | 7/1980 | Jeppsson | 220/270 |
| 4,556,152 | 12/1985 | Bogren | 220/258 |
| 4,693,390 | 9/1987 | Hekal | 220/270 |
| 4,735,336 | 4/1988 | Buchner et al. | 220/270 |
| 4,784,284 | 11/1988 | Miyauchi et al. | 220/270 |
| 4,796,055 | 1/1989 | Ingemann | 220/257 |
| 4,830,215 | 5/1989 | Rebischung | 220/359 |

FOREIGN PATENT DOCUMENTS 0256477 2/1988 European Pat. Off. .

*Primary Examiner*—David T. Fidei

*Attorney, Agent, or Firm*—Sughrue, Mion, Zinn Macpeak & Seas

[57] ABSTRACT

A lid for a can-shaped container which lid is adapted to be connected to a peripheral wall of the can-shaped container is disclosed which comprises a can-shaped container lid base having a gas barrier-type multi-layer base, a thermoplastic resin layer, a score portion formed by thinning part of the thermoplastic resin layer on the upper surface of the bottom of the base into an annular shape; and a synthetic resin tab for opening the can-shaped container lid. The tab is connected to an upper surface of a tab seat constituted by that portion of the thermoplastic resin layer disposed inwardly of the score portion. The score portion is provided by forming a tunnel-like groove at the outer periphery of the tab seat in such a manner that the tunnel-like groove has a suitable height from the surface of contact between the tab seat and the bottom of the can-shaped container lid base, with the thermoplastic resin layer remaining on its outer side above the tunnel-like groove, so as to expose the upper bottom surface of the base to the base to the interior of the tunnel-like groove.

8 Claims, 5 Drawing Sheets

LID FOR CAN-SHAPED CONTAINER

This is a continuation of application Ser. No. 07/358,754 filed May 30, 1989 now abandoned.

BACKGROUND OF THE INVENTION

This invention relates to a lid for a can-shaped container and more particularly to a lid to be connected to a peripheral wall of a can-shaped container or can for holding beverage, such as coffee and juice, soup, solid foodstuffs, etc., the lid being made predominantly of a synthetic resin instead of metal and being openable without any tool such as a can opener. More specifically, the invention relates to an improved score portion enabling the opening of the can.

The present inventors have heretofore made various proposals with respect to lids of the type described above which are adapted to connected to a peripheral wall of a can-shaped container and are made predominantly of a synthetic resin.

One example of such lids will now be described with reference to FIG. 7(D). A lid 1A for a can-shaped container comprises a can-shaped container lid base 2 which comprises a multi-layer base of the gas barrier type and has a bottom 2A, an upstanding portion 2B extending from the outer periphery of the bottom 2A, and a flange 2C extending outwardly from the upstanding portion 2B in substantially parallel relation to the bottom 2A; a thermoplastic resin layer 3 which extends from the outer peripheral edge portion of the upper surface of the bottom 2A, facing away from the other side thereof to be connected to the peripheral wall of the can-shaped container, to the outer end of the flange 2C, and further projects from the outer end of the flange 2C downwardly in substantially parallel relation to the upstanding portion 2B in a direction opposite to the upstanding direction thereof; a tab seat 5 of a synthetic resin formed on that portion of the upper surface of the bottom 2A of the base 2 surrounded by the thermoplastic resin layer 3 in such a manner that there is provided a space 4 between the tab seat 5 and the upper surface of the bottom 2A; and a tab 6 connected at one end to the tab seat 5. The can-shaped container lid 1A has a score portion 7 formed between the outer periphery of the tab seat and the inner peripheral edge of the thermoplastic resin layer 3, the upper surface of the bottom 2A of the base 2 being exposed through the score portion 7.

For example, the lid 1A for a can-shaped container is manufactured as follows. As shown in FIG. 7(A), there is prepared the can-shaped container lid base 2 which has the bottom 2A, the upstanding portion 2B and the flange 2C as described above. Then, as shown in FIG. 7(B), the thermoplastic resin layer 3 is formed so as to reinforce at least the upstanding portion 2B and flange 2C of the base 2. Then, as shown in FIG. 7(C), the tab seat 5 formed on the upper surface of the bottom 2A in such a manner as to form the space 4 and the score portion 7, and the tab 6 is connected to the tab seat 5 to provide the lid 1A for a can-shaped container as shown in FIG. 7(D).

In this case, it is possible that the tab 6 is connected to the tab seat 5 beforehand, and that the thermoplastic resin layer 3 is formed after the tab seat 5 with the tab 6 is connected to the base. Anyway, one of the features of the present invention is to make the width (S) of the score portion 7 (see FIG. 7(C)), formed between the outer periphery of the tab seat 5 and the inner peripheral edge of the thermoplastic resin layer 3, as small as possible.

FIG. 8 is a plan view of the lid 1A for a can-shaped container, and FIG. 9 is a perspective view showing one example in which the can-shaped container lid 1A is mounted on a peripheral wall 8 of the can-shaped container body.

Although for illustration purposes, the can-shaped container lid base 2 used in the can-shaped container lid 1A is cross-sectionally shown as one layer in FIG. 7, using a hatching representative of a resin, the base 2 actually comprises three layers, that is, an inner base layer 200 of the gas barrier type shown as a metal foil, and a pair of thermoplastic resin layers 201 and 202 formed respectively on the opposite sides of the inner base layer as shown in FIG. 6.

As later described, the present inventors have earlier developed a molding method in which the three-dimensional base 2 for a can-shaped container lid, as shown in FIG. 7(A), can be molded without producing any pinholes. Therefore, it is possible to reduce the thickness of the base 2.

For opening the can-shaped container lid 1A, the tab 6 is pulled up as indicated by an arrow in FIG. 7(D), so that the score portion 7, through which the thin base 2 is exposed, is cut to thereby open the can.

FIG. 10 is a plan view of the lid 1A after it is opened, and FIG. 11 is a cross-sectional view taken along the line XI—XI of FIG. 10, showing the lid 1A and the peripheral wall 8 of the can-shaped container after the opening of the can.

Thus, the lid 1A is opened by cutting the score portion 7. If the width (S) of the score portion 7 is too large, the base 2 is liable to be extended due to the stress developing at the time of the opening of the can, thereby greatly lowering the degree of easy opening.

In view of this, in the lid 1A, the tab seat 5 is provided as a separate element, and is connected to the upper surface of the bottom 2A of the base 2 so as to make the width (S) of the score portion 7 as close to zero as possible.

When the width (S) of the score portion 7 is thus made as close to zero as possible, the risk of introducing or injecting a foreign matter into the container through the thin base 2 can be prevented, thus providing an improved tamper resistance.

In such a lid, the easily-opening ability and the rupture strength of the can are those characteristics which are contradictory with each other. When it is intended to improve one of these characteristics, the other characteristic often tends to become unsatisfactory. Thus, such a difficult problem has heretofore been involved in providing a can-shaped container having such a synthetic resin lid which is openable without the use of any tool such as a can opener.

Generally, it is considered that the narrower the width of the score portion 7 is, the greater resistance to withstand a breakage or rupture of the can is obtained. However, the reverse is the case. The greater width the score portion 7 has, the more energy is absorbed when the can is dropped, thus achieving a greater rupture strength.

Anyway, it is necessary for the lid to have a tamper resistance, an easily-opening ability and an increased can rupture strength. In the lid 1A, there is provided the space 4 between the upper surface of the bottom 2A of the can-shaped container lid base 2 and the tab seat 5 in order to increase that portion of the base 2 which can absorb the energy developing when the can is dropped, thereby relieving the concentration of the impact on the score portion 7 when the can is dropped.

In the above lid, even if the width (S) of the score portion 7 is made as close to zero as possible, the score portion is still exposed as shown in FIG. 7(D) (cross-sectional view) and FIG. 8 (plan view). As a result, dirt and the like tend to collect in the score portion 7. This is not only insanitary but also may cause the score portion 7 to be easily damaged. Therefore, it is desirable from this point of view and also from the viewpoint of a tamper resistance that the score portion 7 is not exposed.

In this connection, Japanese Laid-Open (Kokai) Patent Application No. 163641/82 discloses an easily-openable sealing lid of a plastics material for a container which has an upwardly-exposed score portion.

In such a construction, also, dirt and the like tend to collect in the score portion, which is insanitary when the lid is opened, and it is desirable from this point of view and also from the viewpoint of a tamper resistance that the score portion is not exposed.

SUMMARY OF THE INVENTION

It is therefore an object of this invention to provide a lid of a plastics material for a can-shaped container which prevents the collection of dirt and the like, and is sanitary, and has an improved tamper resistance, an easily-opening ability and an increased can rupture strength.

The above and other objects of the invention and novel features thereof will become manifest upon making reference to the detailed description and the accompanying drawings.

The above objects have been achieved by the following constructions.

According to a first aspect of the invention, there is provided a lid for a can-shaped container which lid is adapted to be connected to a peripheral wall of the can-shaped container, comprising: a can-shaped container lid base comprising a gas barrier-type multi-layer base which comprises at three layers, said multi-layer base comprising an inner base layer of the gas barrier type and opposite thin outer surface layers, and said can-shaped container lid base having a bottom, an upstanding portion extending from the outer periphery of the bottom, and a flange extending outwardly from the upstanding portion; a thermoplastic resin layer which extends from the outer peripheral edge portion of the upper surface of the bottom of the base, facing away from the side of the base to be connected to the peripheral wall of the can-shaped container, to the outer end of the flange, and further projects from the outer end of the flange downwardly in substantially parallel relation to the upstanding portion in a direction opposite to the upstanding direction of the upstanding portion; a score portion formed by thinning part of the thermoplastic resin layer on the upper surface of the bottom of the base into an annular shape; and a synthetic resin tab for opening the can-shaped container lid, said tab being connected to an upper surface of a tab seat constituted by that portion of the thermoplastic resin layer disposed inwardly of the score portion; CHARACTERIZED in that said score portion is provided by forming a tunnel-like groove at the outer periphery of the tab seat in such a manner that the tunnel-like groove has a suitable height from the surface of contact between the tab seat and the bottom of the can-shaped container lid base, with the thermoplastic resin layer remaining on its outer side above the tunnel-like groove, so as to expose the upper bottom surface of the base to the interior of the tunnel-like groove.

According to a second aspect of the invention, there is provided a lid for a can-shaped container which lid is adapted to be connected to a peripheral wall of the can-shaped container, comprising: a can-shaped container lid base of a flat shape comprising a gas barrier-type multi-layer base which comprises at three layers, said multi-layer base comprising an inner base layer of the gas barrier type and opposite outer surface thin layers, a thermoplastic resin layer formed on an upper surface of the base; a score portion formed by thinning part of the thermoplastic resin layer on the upper surface of the bottom of the base into an annular shape; and a synthetic resin tab for opening the can-shaped container lid, said tab being connected to an upper surface of a tab seat constituted by that portion of the thermoplastic resin layer disposed inwardly of the score portion; CHARACTERIZED in that said score portion is provided by forming a tunnel-like groove at the outer periphery of the tab seat in such a manner that the tunnel-like groove has a suitable height from the surface of contact between the tab seat and the bottom of the can-shaped container lid base, with the thermoplastic resin layer remaining on its outer side above the tunnel-like groove, so as to expose the upper bottom surface of the base to the interior of the tunnel-like groove.

According to a third aspect of the invention, in the above-mentioned lid, a material of a kind which is different from and does not adhere to the thermoplastic resin layer constituting the tab seat is filled in the tunnel-like groove.

BRIEF DESCRIPTION OF THE DRAWINGS

FIG. 5 are fragmentary cross-sectional views of other embodiments of the invention, respectively;

DESCRIPTION OF THE PREFERRED EMBODIMENTS

Figure 1:
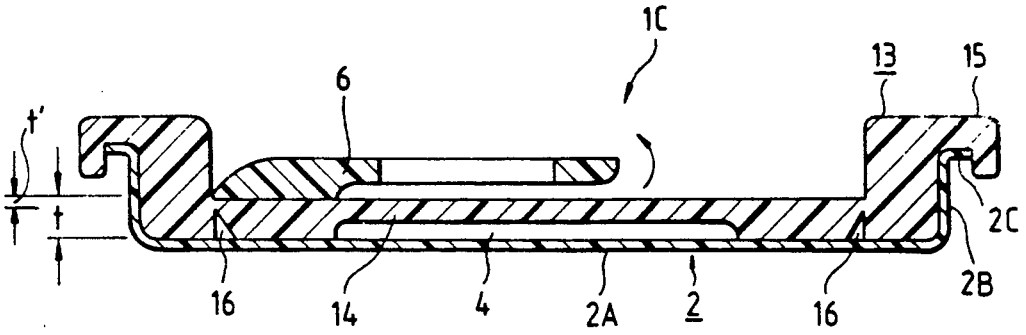
FIG. 1 is a cross-sectional view of a preferred embodiment of a can-shaped container lid of the present invention, taken along the line I—I of FIG. 2.
Figure 2:
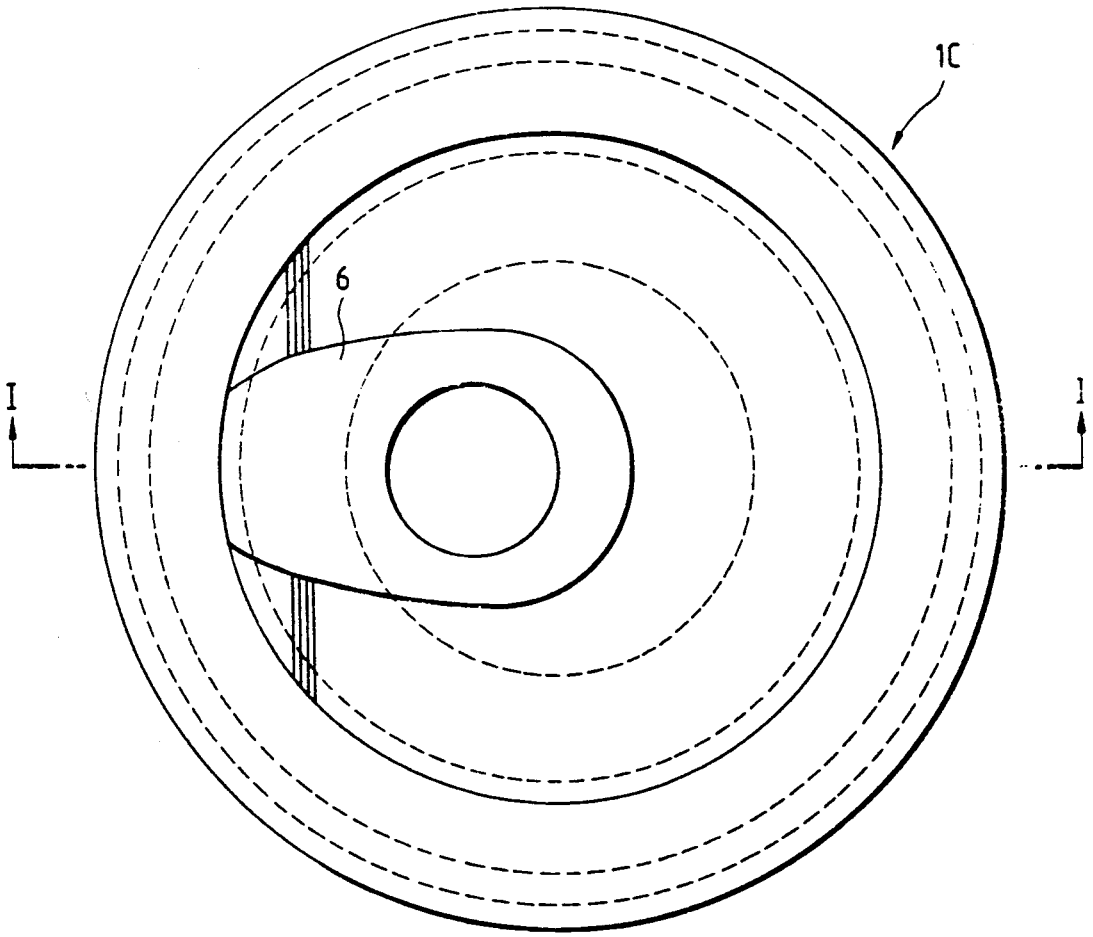
FIG. 2 is a plan view of the lid.

FIG. 1 is a cross-sectional view of a lid for a can-shaped container provided in accordance with a first aspect of the present invention. FIG. 2 is a plan view of the can-shaped container lid, and FIG. 1 is the cross-sectional view taken along the line I—I of FIG. 2.

In the embodiments hereinafter described, parts denoted by like reference numerals or characters have similar functions.

As shown in FIGS. 1 and 2, a base 2 for the can-shaped container lid 1C, like the lid shown in FIGS. 7 and 6(A), comprises a multi-layer base of the gas barrier type, and has a bottom 2A, an upstanding portion 2B extending from the outer periphery of the bottom 2A, and a flange 2C extending outwardly from the upstanding portion 2B in substantially parallel relation to the bottom 2A. A thermoplastic resin layer 13 is formed on the entire upper surface of the bottom 2A of the can-shaped container lid base 2 facing away from the side of the base to be connected to a peripheral wall 8 of the can-shaped container body, and extends from the outer peripheral edge portion of the bottom 2A to the outer end of the flange 2C. The thermoplastic resin layer 13 further projects from the outer end of the flange 2C downwardly in substantially parallel relation to the upstanding portion 2B.

Unlike the thermoplastic resin layer shown in FIG. 7, the thermoplastic resin layer 13 is formed integrally with a tab seat 14.

A groove 16 of a triangular cross-section is formed in the tab seat 14 (which is formed by part of the thermoplastic resin layer 13) adjacent to a flange 15, formed by another part of the thermoplastic resin layer 13 and disposed outwardly of the tab seat 14, the groove 16 having a suitable height from the upper surface of the bottom 2A of the can-shaped container lid base 2 in such a manner that the thermoplastic resin layer 13 constituting the tab seat 14 remains above the groove 16.

In this embodiment, there is shown the lid for a round can, and as shown in phantom in FIG. 2, the circular continuous groove 16 is peripherally provided along the flange 15.

The upper side of the groove 16 is covered by the remaining thermoplastic resin layer 13 constituting the tab seat 14 so as to provide a flat outer surface, and the lower open end of the groove 16 is closed by the upper surface of the bottom 2A of the can-shaped container lid base 2. Therefore, the groove 16 has a tunnel-like shape.

The upper surface of the bottom 2A of the can-shaped container lid base 2 is exposed to the tunnel-like groove 16, and this exposed portion of the base 2 serves as a score portion enabling the opening of the lid, and is cut when a tab 6 is pulled upwardly as indicated by an arrow in FIG. 1, thereby opening the lid 1C.

A space 4 is formed between the upper surface of the bottom 2A of the can-shaped container lid base 2 and the tab seat 14 and is disposed at a suitable position inwardly of the tunnel-like groove 16. Like the tunnel-like groove 16, that portion of the upper surface of the bottom 2A of the can-shaped container lid base 2 exposed to the space 4 is covered by the thermoplastic resin layer 13 constituting the tab seat.

One end of the tab 6 is connected to the upper surface of the tab seat 14 above the tunnel-like groove 16.

Figure 3A:
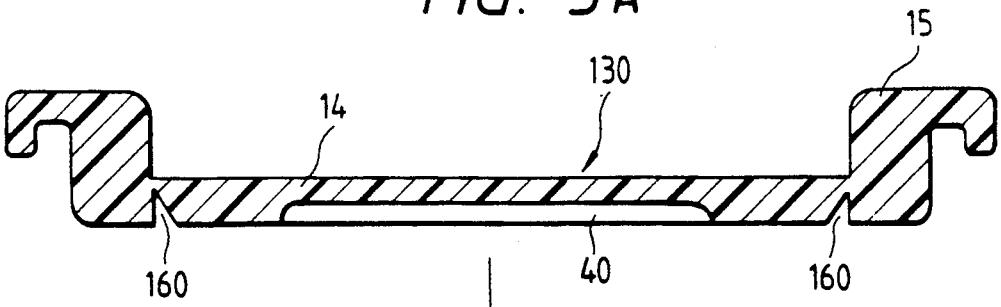
FIGS. 3(A) and 3(B) are cross-sectional views, showing the steps of forming the lid.
Figure 3B:
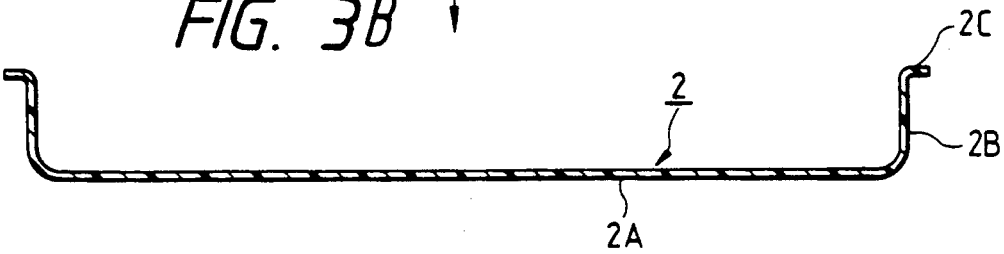

For example, the lid 1C can be formed by joining a lid member 130 of a thermoplastic resin by heat-bonding or the like to the can-shaped container lid base 2 (FIG. 3(B)) having the bottom 2A, the upstanding portion 2B and the flange 2C, the lid member 130 having the unitarily-molded tab seat 14 and flange 15, a notch 160 formed in the outer periphery of the tab seat 14 so as to serve as the tunnel-like groove 16, and a recess 40 for providing the space 4, as shown in FIG. 3(A).

Although not shown in the drawings, the tab 6 may be beforehand connected to the tab seat 14 in a similar manner, or may be connected thereto after the lid member 130 is heat-bonded to the can-shaped container lid base 2.

The can-shaped container lid base 2 of a three-dimensional shape having the bottom 2A, the upstanding portion 2B and the flange 2C can be produced, for example, by stamping reduction machining. Alternatively, for production of the preformed base 2 having a deep bottom (i.e., a high flange type), the base should be formed according to a method disclosed in Japanese Laid-Open (Kokai) Patent application No. 90130/85.

Unlike a conventional drawing method, the above preforming method will not draw the film and will not substantially draw the multi-layer base of the gas barrier type. Therefore, even if a thin metal foil is used as an intermediate layer, pinholes will not develop.

In addition, the preformed product having a uniform thickness can be obtained.

Further, when such a flat plate is formed into a three-dimensional shape, a strain generally develops due to the surplus of the multi-layer base material. To deal with this, such strain is conventionally absorbed by a cutting operation or the like. With the above preforming method, however, such surplus of the base material is absorbed by the wrinkles, thus obviating the need for such cutting operation.

Figure 4:
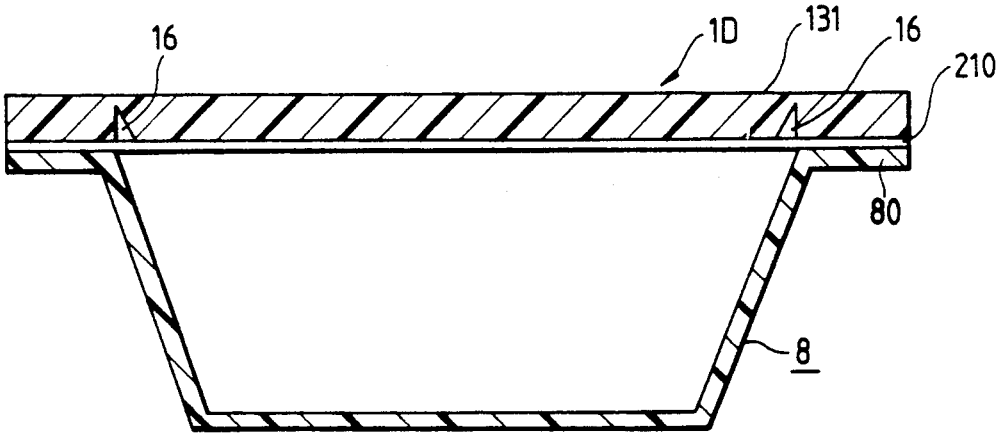
FIG. 4 is a cross-sectional view of another embodiment of a can-shaped container lid connected to a can-shaped container body.

FIG. 4 shows an embodiment according to a second aspect of the invention. In this embodiment, a can-shaped container lid 1D comprises a thermoplastic resin layer 131 having a tunnel-like groove 16 at its outer peripheral portion and also having a flat upper surface, a flat multi-layer base (disc) 210 of the gas barrier type on which the thermoplastic resin layer 131 is formed, and a synthetic resin tab (not shown) connected at one end to the thermoplastic resin layer 131 above the tunnel-like groove 16. The lid 1D is connected at its outer peripheral portion to a flange 80 of a can-shaped container body 8.

Figure 5A:
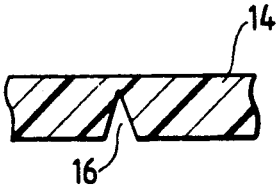
FIGS. 5(A) through 5(D) are cross-sectional views of alternative groove construction.
Figure 5B:
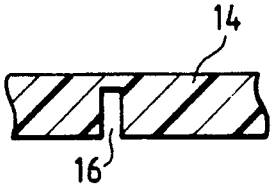
Figure 5C:
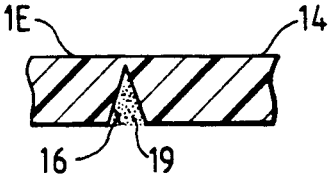
Figure 5D:
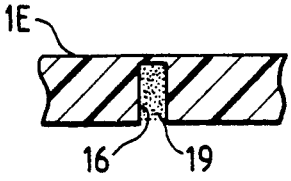

According to a third aspect of the invention, a material 19 of a kind different from the thermoplastic resin layer is filled in the tunnel-like groove 16, as shown in FIG. 5C and FIG. 5D, thereby further enhancing a tamper resistance. In this case, the material 19 is not bonded to the inner surface of the tunnel-like groove 16.

When a synthetic resin is used as the above different kind of material, it is preferred that such synthetic resin be of the type which does not adhere to the thermoplastic resin layer.

The above constructions of the invention will now be described supplementarily.

Figure 6:
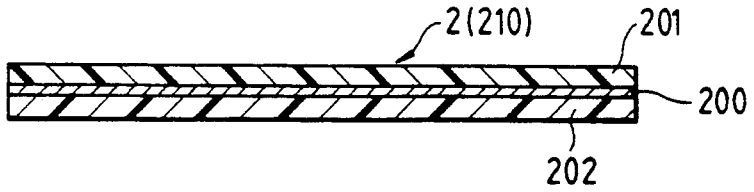
FIG. 6 is a cross-sectional view of a gas barrier-type multi-layer base.
Figure 7A:
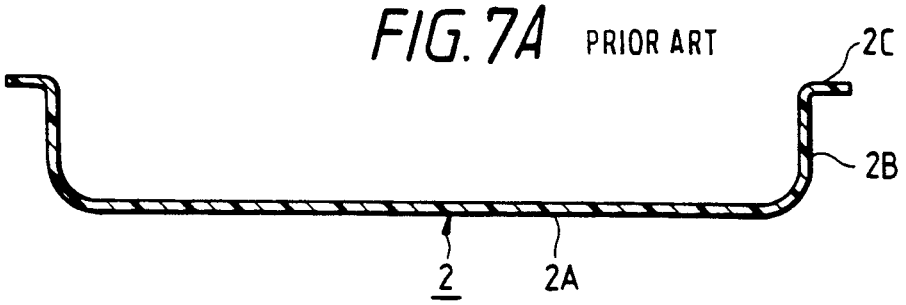
FIG. 7A PRIOR ART
FIGS. 7(A) to (D) are cross-sectional views showing the steps of forming a conventional lid.
Figure 7B:
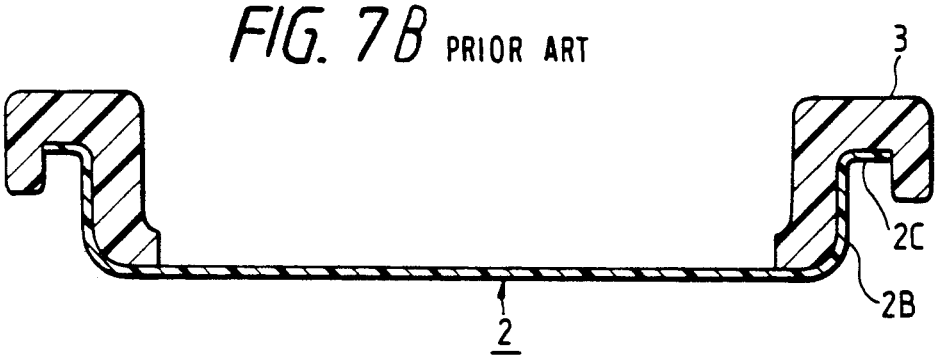
FIG. 7B PRIOR ART
Figure 7C:
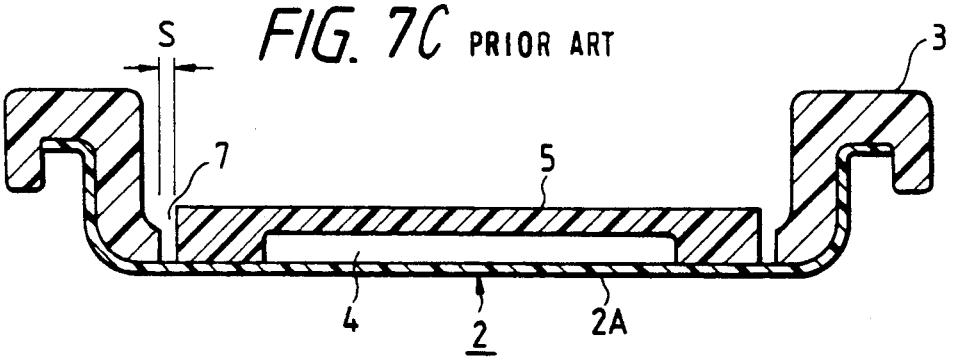
FIG. 7C PRIOR ART
Figure 7D:
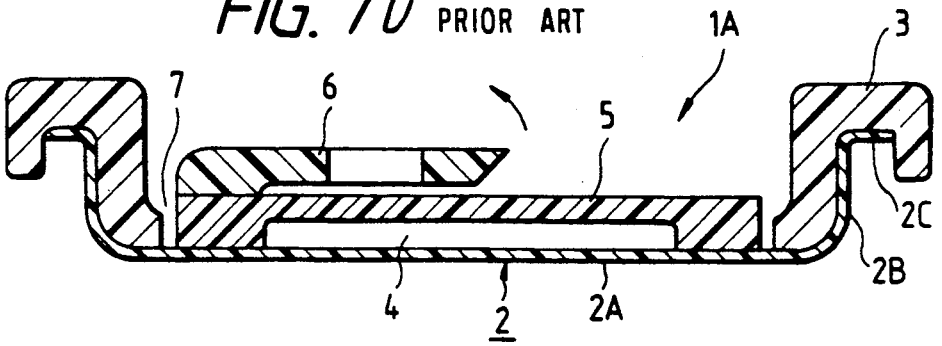
FIG. 7D PRIOR ART
Figure 8:
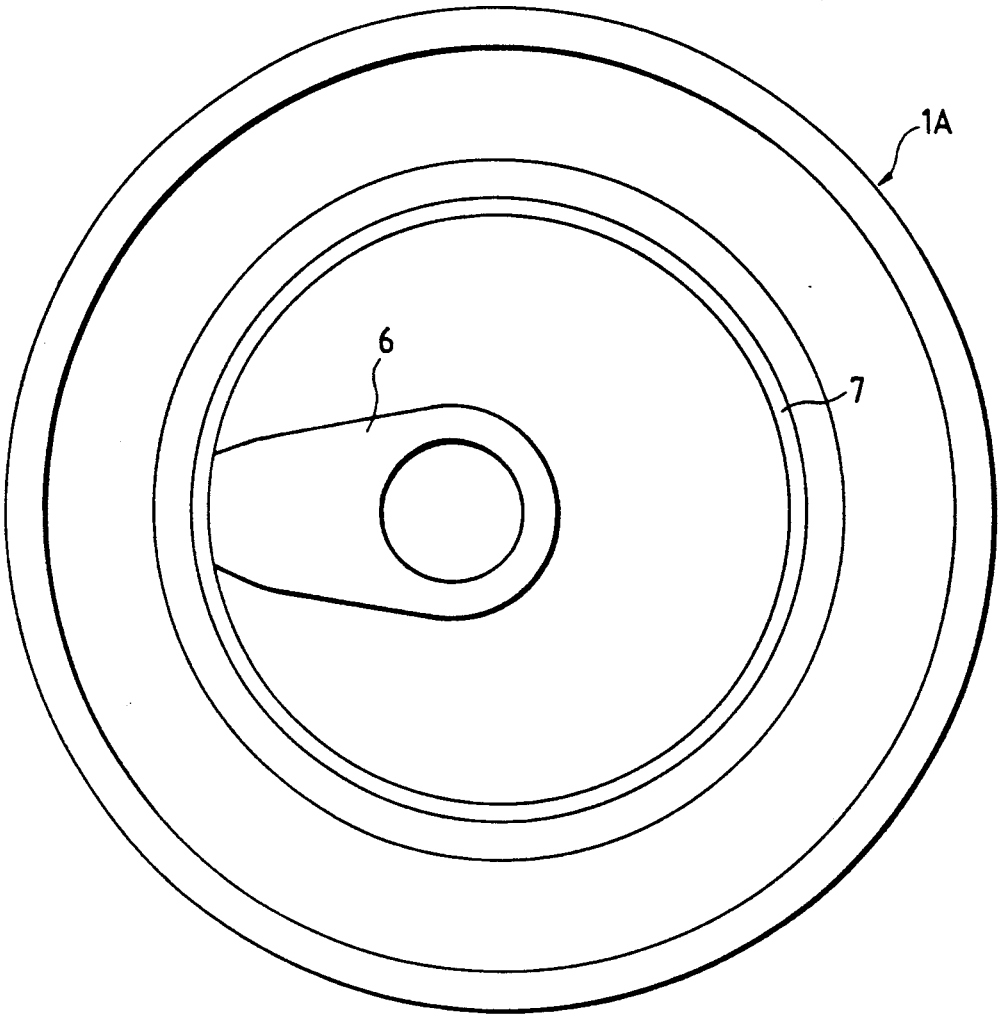
FIG. 8 PRIOR ART
FIG. 8 is a plan view of the conventional lid of FIG. 7(D)

As described above, one example of the gas barrier-type multi-layer base 210 constituting the can-shaped container lid base 2 of the invention is cross-sectionally shown in FIG. 6. The multi-layer base 210 comprises an intermediate base layer 200 of the gas barrier type, and thin resin layers 201 and 202 of the heat-fusible or heat-bondable type formed on the opposite sides of the base layer 200.

It is necessary that the base layer 200 of the gas barrier type should have so-called gas barrier properties to prevent oxygen and impurities from passing therethrough.

Examples of the gas barrier-type base (layer) 200 used in the present invention include the following sheets and films in addition to a metal foil.

One example of such metal foil is an aluminum foil. Particularly, the present invention relates to the can-shaped container lid in which an aluminum foil is used as the gas barrier-type base 200. Other examples of the gas barrier-type base 200 include a film or a sheet of a saponifide of ethylene-vinyl acetate copolymer, vinylidene polychloride, polyamide, polyacrylonitrile or the like.

As described above, the can-shaped container lid 1C, 1D, 1E according to the present invention is so designed that the lid can be opened by cutting the gas barrier-type multi-layer base 210 having the gas barrier-type base layer 200. Taking into consideration the degree of easy opening of the lid, the drop strength of the product, the rupture strength of the can and the breaking strength in connection with the shaping operation, it is preferred that the thickness of the gas barrier-type base layer 200 made of an aluminum foil or the like should be not more than 50 $\mu$, and more preferably 9 to 30 $\mu$.

With such thickness, a complete incineration is possible, and the energy required for such incineration can be reduced to 5,000 to 6,000 Kcal/kg, thus dealing with the problem of disposal of used cans.

Figure 9:
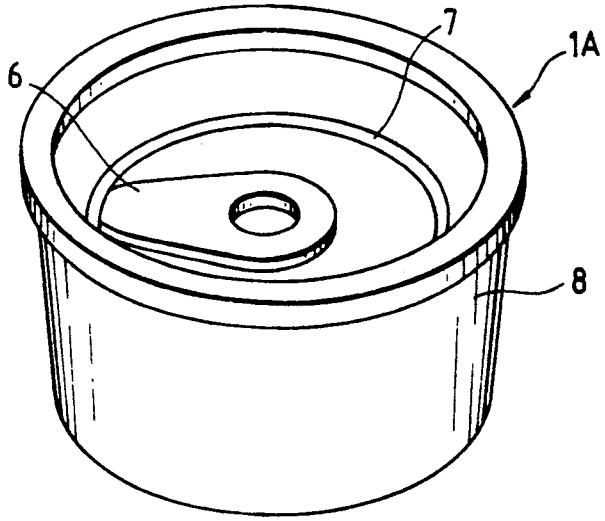
FIG. 9 PRIOR ART
FIG. 9 is a perspective view of a can-shaped container having the conventional lid connected to a peripheral wall of the container.
Figure 10:
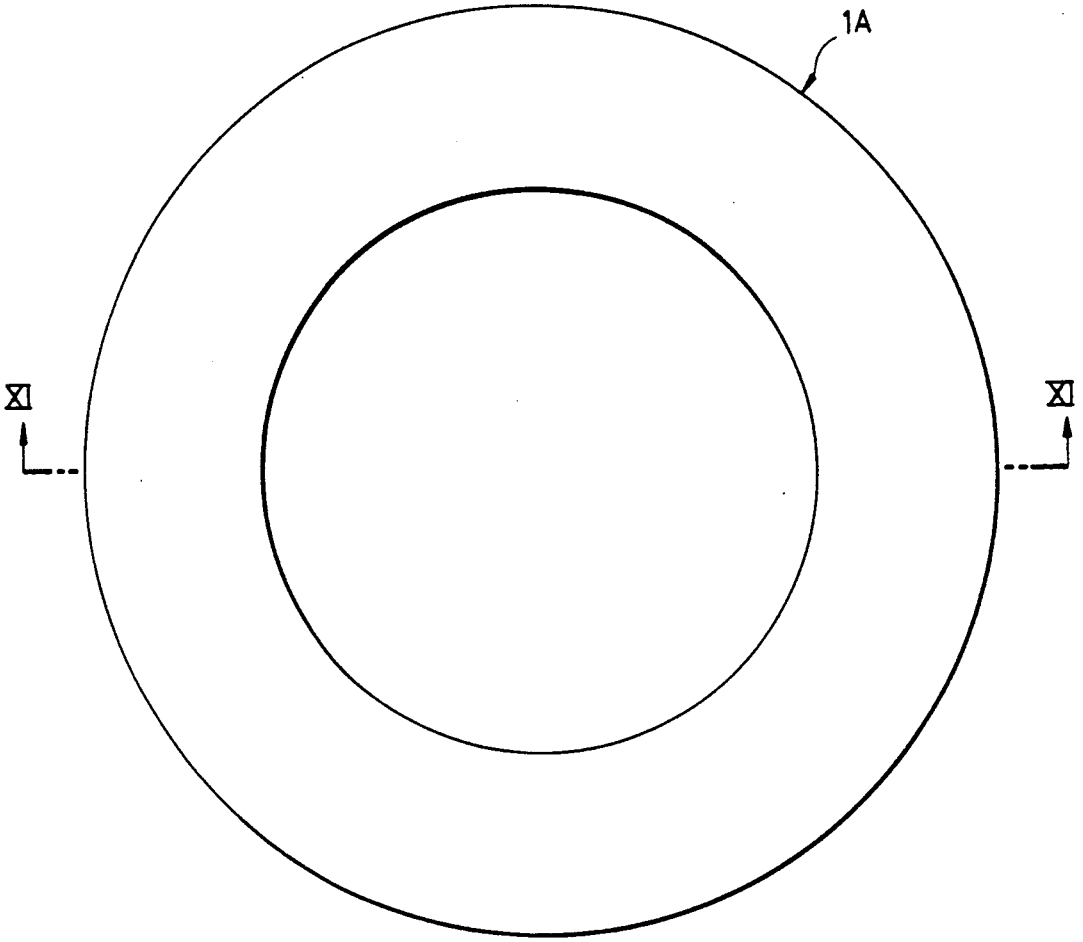
FIG. 10 PRIOR ART
FIG. 10 is a plan view of the conventional lid after it is opened.
Figure 11:
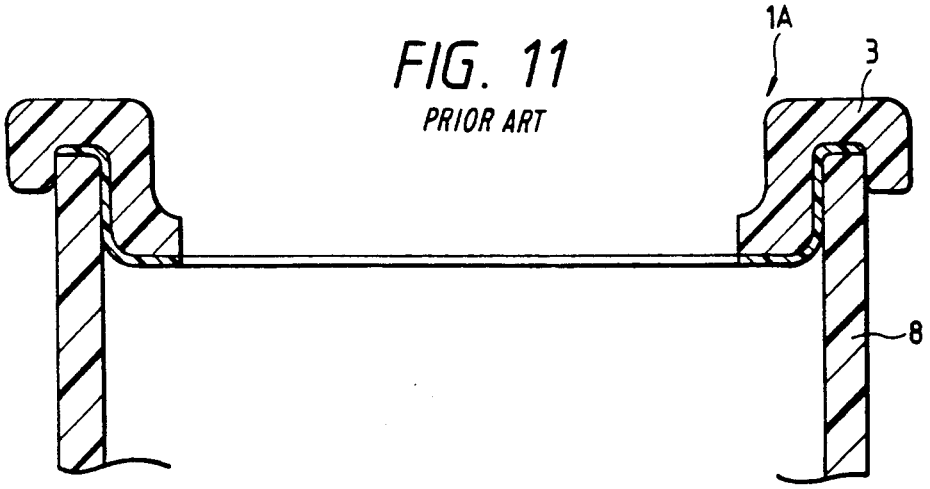
FIG. 11 PRIOR ART
FIG. 11 a fragmentary cross-sectional view taken along the line XI—XI, showing the lid and the peripheral wall of the can-shaped container.

For example, as shown in FIG. 9, the can-shaped container lid of the present invention is secured to the can-shaped container body by heat-bonding the flange 15 to the peripheral wall 8 of the container body. The surface of the peripheral wall 8 is also defined by a similar resin layer.

The heat-fusible outer resin layer 202 of the multi-layer base 210 is bonded to the peripheral wall 8 of the can-shaped container whereas the heat-fusible inner resin layer 201 is heat-fused to the flange 15 and the tab seat 14. Thus, the lid can be firmly heat-bonded to the peripheral wall 8 through the outer layer 202, and the flange 15 and the tab seat 14 can be firmly heat-bonded to the inner layer 201 by ultrasonic welding or the like.

Examples of the resin of which the resin layers 201 and 202 are made include heat-fusible resins such as polyethylene, polypropylene and an ethylene-propylene copolymer.

The inner and outer layers 201 and 202 can be made of the same resin or different resins.

When the resin layers 201 and 202 are to be formed on the gas barrier-type base element 200, this can be done with or without an adhesive or an adhesive resin layer such as a film of a hot melt adhesive.

Preferably, the thickness of each of the resin layers 201 and 202 should be not more than 100 $\mu$ for the same reason as described above for the gas barrier-type base layer 200.

The tab seat 14 and the peripheral flange 15 can be made of a thermoplastic resin similar to that of the resin layers 201 and 202.

When the resin layer 201 is made of an ethylene-propylene copolymer or polypropylene, it is preferred that the tab seat 14 and the flange 15 be made of polypropylene.

The tab 6 can be made of a synthetic resin similar to that of the tab seat 14 and the flange 15.

Various additives such as an inorganic filler can be added to the synthetic resin of which the resin layers 201 and 202, the flange 15 at the peripheral portion of the lid, the tab seat 14 and the tab 6 are made.

Preferably, the thickness (t') (see FIG. 1) of that portion of the thermoplastic resin layer 13 remaining above the tunnel-like groove 16 should be not more than about a half of the thickness (t) of that portion of the thermoplastic resin layer 13 constituting the tab seat 14, and more preferably be not more than 300 $\mu$.

(1) In the present invention, the upper end of the tunnel-like groove at the score portion is covered by the aforesaid remaining portion of the thermoplastic resin layer, and therefore the score portion is not exposed to the exterior, as is the case with the prior art. This prevents dirt and the like from collecting in the score portion, and therefore is desirable from the viewpoint of food hygiene. This also prevents damage to the score portion.

Further, since the score portion is not exposed to the exterior and is concealed from an external view, this is also desirable from the viewpoint of tamper resistance.

(2) In the present invention, at the score portion, the can-shaped container lid base is spaced from the remaining portion of the thermoplastic resin layer by a distance equal to the height of the tunnel-like groove. Thus, such a cross-sectional arrangement is employed in the present invention. Comparing the moment of inertia of such a cross-section with the moment of inertia of the cross-section of the prior art (Japanese Laid-Open Patent Application No. 163641/82) in which the flat rigid plastic sheet layer, the flat rigid metal foil and the flat rigid heat-sealing resin layer are disposed below the score portion, the moment of inertia of the cross-section of the present invention is greater than that of the prior art. Therefore, the present invention can provide a greater can drop strength than the prior art.

In the present invention, the can drop strength can be further improved by providing the space between the can-shaped container lid base and the tab seat.

(3) In the present invention, the remaining portion of the thermoplastic resin layer, the tunnel-like groove and the can-shaped container lid base are arranged in this order at the score portion from above. When the score portion is to be cut by the tab, the remaining portion of the thermoplastic resin layer is cut at a first step, and then at a second step, the can-shaped container lid base is cut. Further, the tamper resistance can be improved while maintaining the function of the score, by filling the separate material in the groove.

In contrast, in the above prior art, all the layers of the laminate (that is, the rigid plastics sheet layer, the rigid metal foil layer and the heat-sealing resin layer) must be cut at a time.

Therefore, the present invention can provide a higher degree of easy opening than the prior art.

Although the invention made by the present inventor have specifically described with reference to the embodiments thereof, the invention is not to be restricted to such embodiments, and various modifications can be made without departing from the scope of the invention.

For example, in the above embodiments, although the groove has a triangular cross-section having one inclined side and one vertical side, the groove may have a triangular cross-section having two inclined sides, as shown in FIG. 5(A). Also, the groove may have a rectangular cross-section as shown in FIG. 5(B) and may have any other suitable shape.

In the above embodiments, although the present invention has been described with reference to the lids for a round can-shaped container, the invention is applicable to lids of a polygonal shape; an oval shape and other shapes.

Further, in addition to the fully-openable type as described above, the invention is applicable to the partially-openable type in which only a drinking portion can be opened.

I claim:

1. A lid for a can-shaped container which lid is adapted to be connected to a peripheral wall of the can-shaped container, comprising: a can-shaped container lid base defining a first sealing structure for sealing said container and comprising a gas barrier-type multi-layer base, said can-shaped container lid base having a planar portion with an upper surface and a lower surface and a central area; a thermoplastic resin layer formed over said upper surface unbonded to said surface over said central area and defining a second sealing structure for sealing said container independent of said first sealing structure; a score portion formed by thinning part of the thermoplastic resin layer above the upper surface of said planar portion of the base into an annular shape; and a synthetic resin tab for opening the can-shaped container lid, said tab being connected to an upper surface of a tab seat constituted by that portion of the thermoplastic resin layer disposed inwardly of said score portion and outwardly of said central area; wherein said score portion is provided by forming a tunnel-like groove at the outer periphery of the tab seat in such a manner that the tunnel-like groove has a suitable height from the surface of contact between the tab seat and said upper planar portion of the can-shaped container lid base, with the thermoplastic resin layer remaining on an outer side above the tunnel-like groove, so as to expose the upper surface of the base planar portion to the interior of the tunnel-like groove.

2. The lid according to claim 1, wherein said base comprises at least three layers comprising an inner base layer of the gas barrier type and opposite thin outer surface layers.

3. The lid according to claim 1, wherein said can-shaped container lid base further includes an upstanding portion extending from the outer periphery of the planar portion and a flange extending outwardly from the upstanding portion.

4. The lid according to claim 3, wherein said thermoplastic resin layer extends from the outer peripheral edge portion of the upper surface of the planar portion of the base, facing away from the side of the base to be connected to the peripheral wall of the can-shaped container, to the outer end of the flange, and further projects from the outer end of the flange downwardly in substantially parallel relation to the outstanding direction of the upstanding portion.

5. The lid according to claim 1, wherein a material of a kind which is different from and does not adhere to the inner surface of said tunnel like groove is filled in said tunnel-like groove.

6. A lid for a can-shaped container which lid is adapted to be connected to a peripheral wall of the can-shaped container, comprising: a can-shaped container lid base of a flat shape defining a first sealing, structure for sealing said container and having a central area; a thermoplastic resin layer formed over an upper surface of the base and defining a second sealing structure for sealing said container independent of said first sealing structure and being unbonded to said first sealing structure over said central area; a score portion formed by thinning part of the thermoplastic resin layer above the upper surface of the base into an annular shape; and a synthetic resin tab for opening the second sealing structure of the can-shaped container lid but not said first sealing structure, said tab being connected to an upper surface of a tab seat constituted by a portion of the thermoplastic resin layer disposed inwardly of the score portion and outwardly of said central area; wherein said score portion is provided by forming a tunnel-like groove at the outer periphery of the tab seat in such a manner that the tunnel-like groove has a suitable height from the surface of contact between the tab seat and the top of the can-shaped container lid base, with the thermoplastic resin layer remaining on an outer side above the tunnel-like groove, so as to expose the upper surface of the base planar portion to the interior of the tunnel-like groove.

7. The lid according to claim 6, wherein a material of a kind which is different from and does not adhere to the inner surface of said tunnel like groove is filled in said tunnel-like groove.

8. The lid according to claim 6, wherein said lid base comprises a gas barrier-type multi-layer base which comprises at least three layers, said multi-layer base comprising an inner base layer of the gas barrier type and opposite outer surface thin layers.

* * * * *